US006155307A

United States Patent [19]

Vanneste

[11] Patent Number: 6,155,307

[45] Date of Patent: Dec. 5, 2000

[54] KNIFE CARRIAGE FOR FACE-TO-FACE WEAVING MACHINES

[75] Inventor: Stéphan Vanneste, Rekkem-Menen, Belgium

[73] Assignee: N.V. Michel Van de Wiele, Kortrijk/Marke, Belgium

[21] Appl. No.: 09/306,812

[22] Filed: May 7, 1999

[30] Foreign Application Priority Data

May 26, 1998 [BE] Belgium ..... 09800398

[51] Int. Cl.[7] ..... D03D 39/18; D03D 39/24; D03J 1/08

[52] U.S. Cl. ..... 139/291 C; 26/14; 139/21; 384/42

[58] Field of Search ..... 384/42; 139/21, 139/43, 291 C; 26/14

[56] References Cited

U.S. PATENT DOCUMENTS 4,561,473 12/1985 Yonehana et al. ..... 139/21
5,076,331 12/1991 Debaes ..... 139/291 C
5,417,497 5/1995 Rumler .

FOREIGN PATENT DOCUMENTS 2 088 730 1/1972 France .
36 14 992 6/1987 Germany .

*Primary Examiner*—Andy Falik
*Attorney, Agent, or Firm*—James Creighton Wray; Meera P. Narasimhan

[57] ABSTRACT

A knife carriage for face-to-face weaving machines has a supporting surface with interchangeable, adjustable sliding parts which direct the knife carriage in relation to a guiding section. A cutting instrument separates top and bottom fabrics from each other. The instrument has attachment(s) for a drive cord from a drive mechanism for the knife carriage. The sliding parts and the attachment(s) for the drive cord on the supporting surface have a device, which when tightened, makes the attachment line of the device coincide respectively with the contact line of the sliding parts with the supporting surface, and surface the contact surface of the attachment(s) with the supporting surface. The length of the supporting surface is smaller than the distance between the extremities of the sliding parts protruding in relation to the supporting surface in longitudinal direction of the knife carriage. The width of the supporting surface is smaller than the distance between the sides of the sliding parts protruding in relation to the supporting surface in transverse direction of the knife carriage.

5 Claims, 1 Drawing Sheet

KNIFE CARRIAGE FOR FACE-TO-FACE WEAVING MACHINES

BACKGROUND OF THE INVENTION

The invention relates to a knife carriage as is utilized in face-to-face weaving machines.

On a face-to-face weaving machine two backing fabrics are woven one above the other whereby two weft threads are simultaneously inserted in two sheds located one above the other. These backing fabrics are connected by pile warp threads. On the machine these pile warp threads are cut through with a cutting device so that ultimately a top and a bottom fabric are obtained. The cutting device of a face-to-face weaving machine consists of a cutting bench, a so-called knife carriage or cutting carriage, and a drive for the movement of the knife or cutting carriage.

The cutting bench has a guiding with e.g. a trapezoid-shaped cross-section (dovetail) on which the knife carriage is moved back and forth. On the knife carriage a cutting knife is attached with which the fabric is separated into bottom and top fabric. The knife carriage is pulled back and forth on the guideway by a cord that is for example alternately wound up and unwound on a drive cylinder. For this purpose a drive device is for example utilized as described in the European patent publication EP 0 399 501.

In order to obtain a perfect cut the knife carriage may not wobble during its movement on the cutting bench and nevertheless a certain play needs to be present in order for it to be able to slide. For that purpose the supporting plate will be as stiff as possible in order to keep the sliding surfaces flat. The sliding surfaces themselves are subject to wear and tear and need therefore to be easily replaceable. For this purpose detachable sliding parts have been developed. In order for accurate adjustment of the guiding path also to be possible at least two sliding parts will be adjustable. Considering the knife carriage is subject to a fast back and forth movement, the knife carriage will also be made as light as possible in order to limit the tractive forces in the cord and in order not to load the drive mechanism unnecessarily by providing a higher power in the drive.

Such cutting devices are for example known from the German patent publication DE OS 31 18 188. The knife carriage described therein has interchangeable and adjustable sliding parts. In order to limit the mass of the knife carriage the supporting plate is made of light metal and the sliding parts of synthetic material provided with a hard bearing material. In the supporting plate of the knife carriage two slots are made for receiving the sliding parts. Through the milling of these slots a light metal plate has a tendency to buckle. The supporting plate is however made of a solid piece and extends in width over the entire width of the trapezoid-shaped guiding surface plus the width of the oblique side sliding surfaces. The place where the sliding parts are screwed on requires extra mass which makes the carriage wider and therefore makes it weight more. Such a knife carriage weighs around 450 g. For the present operating speeds of a velvet weaving machine around 400 revs./min at 1.50 m weaving width and 150 revs./min for a 4.00 m wide face-to-face carpet weaving machine this mass of a knife carriage is still too heavy: the driving cord breaks prematurely and the drive consumes a large amount of power.

DE GM 87 10 823 describes a knife carriage also with interchangeable and adjustable sliding surfaces. In order to limit the mass here the supporting plate is made of synthetic material. With this embodiment there are two openings in the longitudinal direction of the supporting plate, through which the supporting plate loses rigidity and the plate has the tendency to buckle. In those openings there comes a type of reinforcement in order to give the supporting plate more tensile strength and in order to increase the rigidity in longitudinal direction. This adaptation is reflected in the cost price. For the positioning of the sliding surfaces four millings are necessary. This is not conducive to the sliding surfaces being flat. The sliding surfaces have extra mass at the locations where the attachment screws come and the supporting plate is because of this also wider than the underlying guiding surface. Such a knife carriage ultimately still weighs 400 g. The attachment of the cord with clamps and two bolts causes a bending moment in the supporting plate so that this will deform through which the knife carriage will wobble during its back and forth movement.

In DE PS 36 14 992 a knife carriage is described with built-in dry lubricant. The sliding surfaces have extra mass at the oblique sides of the trapezoid-shaped guide on the cutting bench. Through the one-sided attachment the sliding surfaces buckle and there is more wear and tear and therefore premature play with increased chance of bad cutting.

This is also the case with a knife carriage described in DE GM 86 27 022.

In DE OS 30 06 497 a knife carriage is described with roller wheels as guiding means. With such an embodiment an extra wide supporting plate is necessary, which gives an unacceptably heavy knife carriage.

SUMMARY OF THE INVENTION

It is the purpose of this invention to eliminate the above mentioned disadvantages and to provide a knife carriage which has considerably less mass and is nevertheless rigid enough to counteract deformations.

For this purpose a knife carriage for face-to-face carpet weaving machines is provided comprising a supporting surface or supporting plate provided with interchangeable, adjustable sliding parts or sliding surfaces which direct the knife carriage in relation to a guiding section, with a cutting instrument for separating the top and bottom fabric from each other, and with an attachment for a guiding cord from a drive mechanism for the knife carriage, whereby, in order to minimize the weight of the unit and in order to optimize the form retention/rigidity of the unit, the sliding parts (2) and the attachment(s) (3) for the drive cord on the supporting surface (1) are provided by means of provisions which, with tightening of those provisions, make the attachment line (i.e. the line of the attachment points) of those provisions coincide respectively with the contact line of the sliding parts with the supporting surface, and the contact line of the attachment(s) for the drive cord with the supporting surface.

Or, expressed differently, whereby the sliding parts and the attachment(s) for the drive cord on the supporting surface are provided by means of provisions which exhibit no preponderant resultant of forces when tightening the attachments and/or with respect to buckling of the supporting surface.

Or, expressed still differently, whereby the attachment points for the attachment of the sliding parts on the supporting surface, and the attachment points for the attachment of the drive cord on the supporting surface, in each case, in respect to buckling of the supporting surface, exert preponderant lifting forces on that supporting surface.

Preferably the length of the supporting surface is also provided smaller than the distance between the extremities of the sliding parts protruding in relation to the supporting surface, in the longitudinal direction of the knife carriage, and/or the width of the supporting surface smaller than the distance between the sides of the sliding parts protruding in relation to the supporting surface, in the transverse direction of the knife carriage.

According to a particularly suitable embodiment of the invention each attachment for the guiding cord comprises one mounting clamp which is provided on the supporting surface via attachment points which lie in one line in the longitudinal direction of the supporting surface, and one clamping bracket which is tightened via attachment points on the attachment clamp.

The attachment points of the attachment clamps on the supporting surface are moreover preferably situated according to a central line in the longitudinal direction of the supporting surface, and the attachment points of the clamping bracket on the attachment clamps for clamping the drive cord are preferably situated transverse to the longitudinal direction of the base and loose from the base.

The contact line of the attachment clamps therefore lies in the line of the attachment points so that no bending forces are exerted on the supporting plate.

According to a further preferred characteristic of the invention the bottom side of the supporting surface is made at least partly in the form of a reference surface against which the sliding parts are tightened, while the sliding parts are provided with a raised supporting surface which fits against the aforesaid reference surface. The line of the attachment drill holes lies in the middle of this raised supporting surface and the contact line therefore lies in the middle of this raised supporting surface.

According to the invention an edge can be provided on the sides of the supporting surface, and/or a stop plate be mounted on the bottom side of the supporting surface against which the sliding parts are rested and/or directed.

According to yet another preferred characteristic of the invention the sliding parts are attached with two or more studs according to the axial line of their top surface onto the supporting plate.

The characteristics and distinctive features of the invention, and the operation thereof are further explained below with reference to the attached drawings which show a preferred embodiment of the invention. It should be noted that the specific aspects of this embodiment are only described as example of what is intended in the scope of the above general specification of the invention, and may in no way be interpreted as a restriction on the scope of the invention as such and as expressed in the following claims.

DETAILED DESCRIPTION

Figure 1:
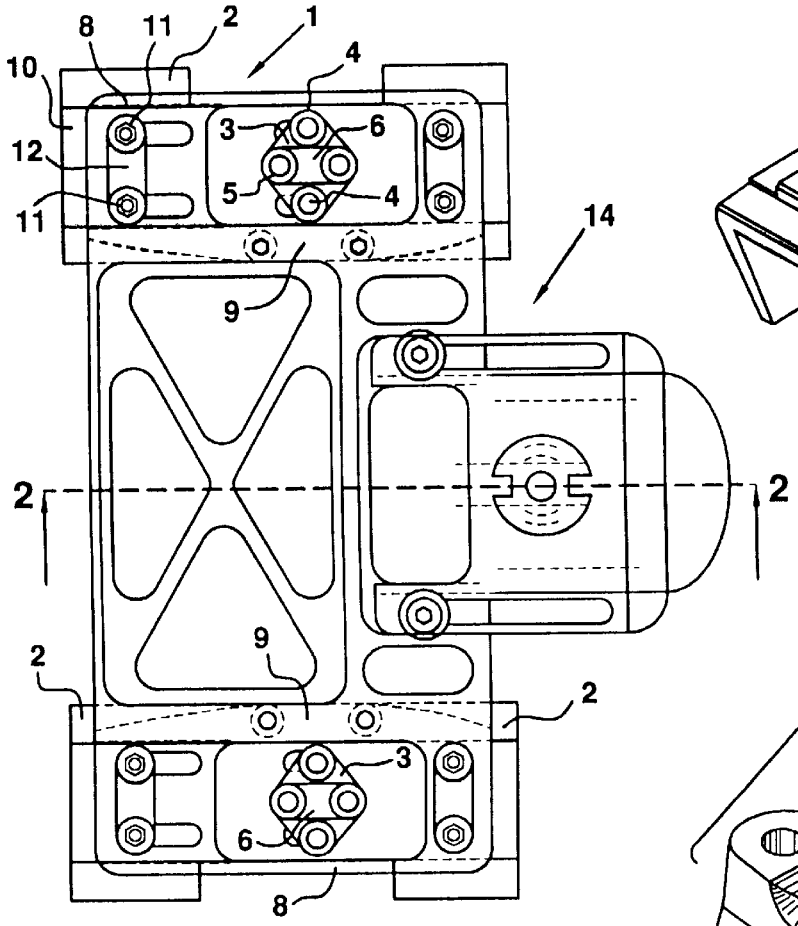
FIG. 1: is a view from above of a knife carriage according to the invention.
Figure 4:
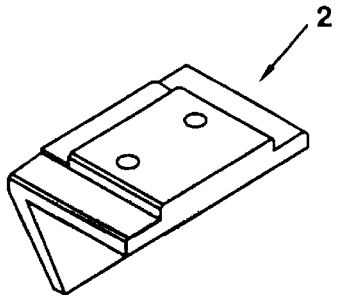
FIG. 4: is a view in perspective of a sliding part for a knife carriage according to FIG. 1.
Figure 5:
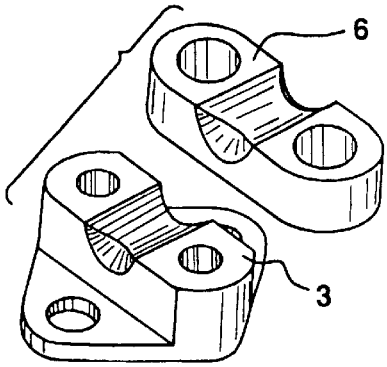
FIG. 5: is a view in perspective of a mounting clamp and a clamping bracket for the drive cord, for a knife carriage according to FIG. 1.
Figure 2:
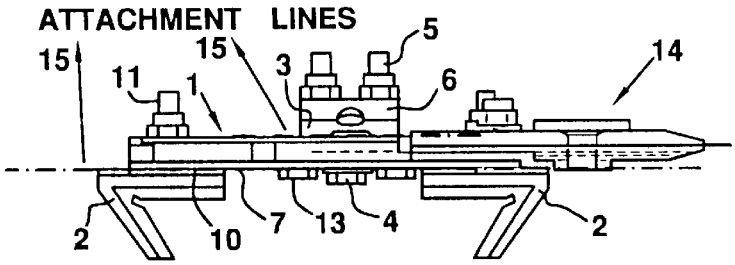
FIG. 2: is a cross-section according to the plane 2—2 from FIG. 1.
Figure 3:
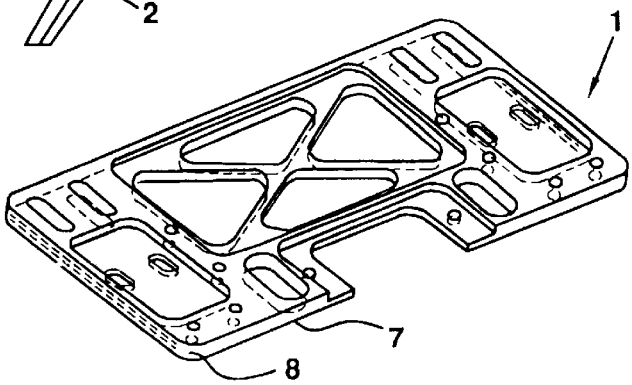
FIG. 3: is a view in perspective of a supporting plate for a knife carriage according to FIG. 1.

The knife carriage shown in the figures comprises a supporting plate, indicated in its entirety by the reference (1).

The supporting plate (1) is preferably made of aluminum. A carbon fiber or glass-fiber reinforced synthetic material is also suitable.

In order to reduce the mass appreciably the length of the supporting plate (1) is taken smaller than the "over-measured" length of the sliding parts (2), i.e. the length of the supporting surface is smaller than the distance between the extremities of the sliding parts protruding in relation to the supporting surface, in the longitudinal direction of the knife carriage.

The sliding parts need to lie at a certain minimum length from one another in order to avoid self-gripping of the knife carriage on the guiding section under the influence of the eccentric loading caused by the resistance on the cutting knife (14).

The width of the supporting plate is also limited and is smaller than the "over-measured" width of the sliding parts, i.e. the width of the supporting surface is smaller than the distance between the sides of the of the sliding parts protruding in relation to the supporting surface, in the transverse direction of the knife carriage.

The supporting plate (1) is restricted in thickness to 4.5 mm, and, where no attachment elements are necessary, openings are provided. This results in a mass of the supporting plate of 76 grams (g) as opposed to 205 g according to the state-of-the-art.

In order to prevent deformation of the supporting plate (1) through effect of the attachment of the cord, the attachment is specially implemented. The mounting clamps (3) themselves are screwed onto the supporting plate with screws (4) which are placed in a line in the longitudinal direction of the supporting plate. The screws (5) for tightening the top clamping bracket (6) are placed in transverse direction. When the screws (5) of the top clamping bracket (6) are now tightened on the cord, then the bottom clamp (3) can bend freely without deforming the baseplate (1) along with it, because the attachment screws (4) on the baseplate lie in the neutral bend line of the bottom clamping bracket (3). Such an attachment provides attachment lines 15. The attachment line is a virtual line connecting attachment points. The attachment points are the points where physical forces work when the attachment means are tightened and/or when the knife carrier is operating.

The bottom side of the baseplate (1) is made as/with a reference surface (7) against which the sliding parts (2) are tightened. Only on the sides is an edge (8) provided against which the sliding parts (2) rest and because of this maintain their proper direction. In this manner the supporting plate (1) shows no tendency to buckling, because no milled-in slots appear. A second guiding of the sliding parts is provided by screwing on—by means of fastening bolts (13)—a thin stop plate (9). With the supporting plate edge (8) and this stop plate (9) a guiding channel is formed through which the sliding parts (2) maintain the correct direction when adjusting the play on the cutting bench.

On their top the sliding parts have a raised supporting surface (10) that fits against the reference surface (7) of the supporting plate (1). This projecting surface (10) fits into the channel formed by the edge (8) of the supporting plate and the screwed-on stop plate (9). The sliding parts are attached by two studs (11) in the middle of their top surface, and by a clamping plate (12) onto the supporting plate (1). Because of this the sliding parts (2) are less deformed when tightening the nuts on the studs (11). The mass on the sides of the sliding parts (2) can be completely omitted. The studs (11) are glued into the sliding parts (2). The studs (11) are secured on the supporting plate (1) with a lock nut.

The cutting knife with its supporting element, indicated in their entirety by the reference (3), is of a construction known in itself.

The result of this knife carriage is that the total mass is reduced to 300 g as opposed to 450 g for the state-of-the-art. This knife carriage is very feasible and maintains its flat running properties through which the tendency to wobble is greatly reduced.

What is claimed is:

1. Knife carriage for face-to-face weaving machines comprising a supporting surface having interchangeable, adjustable sliding parts for directing the knife carriage in relation to a guiding section, a cutting instrument for separating top and bottom fabrics from each other, an attachment to the cutting instrument for a drive cord from a drive mechanism for the knife carriage, means for connecting the sliding parts and the attachment for the drive cord to the supporting surface, wherein tightening the means allows an attachment line of the means to coincide respectively and to align contact surfaces of the sliding parts with the supporting surface and to align a contact surface of the attachment with the supporting surface, and wherein a length of the supporting surface is smaller than a distance between extremities of the sliding parts protruding in relation to the supporting surface, in a longitudinal direction of the knife carriage.

2. Knife carriage for face-to-face weaving machines comprising a supporting surface provided with interchangeable, adjustable sliding parts which direct the knife carriage in relation to a guiding section, with a cutting instrument for separating top and bottom fabrics from each other, and with attachments for a drive cord from a drive mechanism for the knife carriage, wherein the sliding parts and the attachments for the drive cord are connected to the supporting surface by means which, during tightening of the means, makes the attachment line of the means coincide respectively with the contact surface of the sliding parts with the supporting surface, and with the contact surface of the attachments for the drive cord with the supporting surface, and wherein a width of the supporting surface is smaller than a distance between sides of the sliding parts protruding in relation to the supporting surface, in a transverse direction of the knife carriage.

3. Knife carriage for face-to-face weaving machines comprising a supporting surface provided with interchangeable, adjustable sliding parts which direct the knife carriage in relation to a guiding section, with a cutting instrument for separating top and bottom fabrics from each other, and with attachments for a drive cord from a drive mechanism for the knife carriage, wherein the sliding parts and the attachments for the drive cord are connected to the supporting surface by means which, during tightening of the means, make an attachment line of those means coincide respectively with the contact surface of the sliding parts with the supporting surface, and with the contact surface of the attachments for the drive cord with the supporting surface, and wherein each attachment for the drive cord comprises one mounting clamp which is provided on the supporting surface via attachment points which lie in one line in the longitudinal direction of the supporting surface, and one clamping bracket which is tightened via attachment points on the mounting clamp, wherein said attachment points of the attachment clamps lie according to a central line in the longitudinal direction of the supporting surface, and said clamping bracket for the drive cord lies transverse to the longitudinal direction of the surface.

4. Knife carriage for face-to-face weaving machines comprising a supporting surface provided with interchangeable, adjustable sliding parts which direct the knife carriage in relation to a guiding section, with a cutting instrument for separating top and bottom fabrics from each other, and with attachments for a drive cord from a drive mechanism for the knife carriage, wherein the sliding parts and the attachments for the drive cord are connected to the supporting surface by means which, when tightening the means, make an attachment line of the means coincide respectively with the contact surface of the attachments for the drive cord with the supporting surface, and wherein an edge is provided on the sides of the supporting surface against which the sliding parts are abutting, and a stop plate mounted on the bottom side of the supporting surface against which the sliding parts are abutted.

5. Knife carriage for face-to-face weaving machines comprising a supporting surface provided with interchangeable, adjustable sliding parts which direct the knife carriage in relation to a guiding section, with a cutting instrument for separating top and bottom fabrics from each other, and with an attachment for a drive cord from a drive mechanism for the knife carriage, wherein the sliding parts and the attachments for the drive cord are connected to the supporting surface, by one or more means which, when tightening those means, make the attachment line of those means coincide respectively with the contact surface of the sliding parts with the supporting surface, and with the contact surface of the attachment for the drive cord with the supporting surface;

length of the supporting surface being smaller than the distance between the extremities of the sliding parts protruding in relation to the supporting surface, in the longitudinal direction of the knife carriage;

the supporting surface being smaller than the distance between the sides of the sliding parts protruding in relation to the supporting surface, in the transverse direction of the knife carriage;

each attachment for the drive cord comprising one mounting clamp which is provided on the supporting surface via attachment points which lie in one line in the longitudinal direction of,the supporting surface, and one clamping bracket which is tightened via attachment points on the attachment clamp, whereas said attachment points of the attachment clamps lie according to a central line in the longitudinal direction of the supporting surface, and said clamping bracket for the drive cord lies transverse to the longitudinal direction of the base;

an edge being provided on the sides of the supporting surface against which the sliding parts are rested/directed, and a stop plate being mounted on the bottom side of the supporting surface against which the sliding parts are likewise rested and/or directed.

* * * * *